United States Patent [19]

Sugarek et al.

[11] Patent Number: 4,964,683

[45] Date of Patent: Oct. 23, 1990

[54] PILL REMINDER APPARATUS

[76] Inventors: Steven L. Sugarek, 910 Buoy Rd., Houston, Tex. 77062; Chester A. Sugarek, Jr., 6605 Rowan La., Houston, Tex. 77074

[21] Appl. No.: 536,952

[22] Filed: Jun. 11, 1990

Related U.S. Application Data

[63] Continuation of Ser. No. 411,696, Sep. 25, 1989, abandoned.

[51] Int. Cl.[5] ..... A46B 17/00

[52] U.S. Cl. ..... 312/207; 312/276; 312/319; 206/361; 206/362.3; 206/15.3; 206/555

[58] Field of Search ..... 206/15.2, 15.3, 361, 206/362.2, 362.3, 528, 540, 555; 15/106, 184; 312/207, 273, 276, 319, 323, 333; 220/284

[56] References Cited

U.S. PATENT DOCUMENTS

| | | | |
|---|---|---|---|
| 551,316 | 12/1895 | Hutchinson et al. | 312/319 |
| 2,031,115 | 2/1936 | Lindbloom et al. | 206/362.3 |
| 2,377,120 | 3/1942 | Apfelbaum . | |
| 2,401,058 | 3/1944 | Dunleavy . | |
| 2,526,422 | 10/1950 | Roberts | 312/319 |
| 2,564,472 | 6/1948 | Farnham . | |
| 2,950,946 | 8/1960 | Starworth | 312/207 |
| 3,429,474 | 2/1969 | Cann | 206/15.3 |
| 3,911,856 | 10/1975 | Ewing . | |
| 3,915,525 | 10/1975 | Taube | 312/207 |
| 4,473,152 | 9/1984 | Jump, Jr. et al. | 206/362.3 |
| 4,535,903 | 8/1985 | Franchi . | |
| 4,759,383 | 7/1988 | Phillips | 134/93 |

FOREIGN PATENT DOCUMENTS

| | | | |
|---|---|---|---|
| 477863 | 10/1969 | Switzerland | 206/361 |

*Primary Examiner*—David T. Fidei

*Attorney, Agent, or Firm*—Browning, Bushman, Anderson & Brookhart

[57] ABSTRACT

A first housing has an opening for a toothbrush handle. A second housing within the first housing automatically rotates to an open position upon the removal of the toothbrush, exposing the pills or other medicine contained within the second housing to a potential pill taker. In a second embodiment, a toothbrush having a serrated handle cannot be removed from the housing until the pill drawer is first opened. In a third embodiment, the toothbrush cannot be reinserted in the first housing without first moving the second housing containing the pills towards the open position.

2 Claims, 2 Drawing Sheets

PILL REMINDER APPARATUS

RELATED APPLICATIONS

This application is a continuation of U.S. Patent Ser. No. 411,696, filed Sept. 25, 1989, now abandoned.

BACKGROUND OF THE INVENTION

1. Field of the Invention

This invention relates, generally, to apparatus for reminding people to take pills or other forms of medicine on a periodic basis, and specifically, to a pill reminding apparatus which is also used on a periodic basis for some purpose not necessarily related to the taking of the medicine.

2. Description of the Background

Many devices have been developed in this art for reminding people, for example elderly people, to take one or more pills on a periodic basis. Typical of this art is that illustrated and described in U.S. Pat. No. 3,911,856 to Charles C. Ewing which uses a rotary device to dispense the pills upon some predetermined cycle.

Another dispenser known in this art is that illustrated in U.S. Pat. No. 2,377,120 to H. L. Apfelbaum which prevents more than one pill being dispensed at a time.

As yet another example of an apparatus known in this art is that illustrated in U.S. Pat. No. 4,535,903 to Roberto D. Franchi which relates to a pill dispenser having a child proof top.

It is also known in a nonanalogous art to provide an apparatus which encloses a plurality of tooth brushes and which allows a selected one of such tooth brushes to automatically come out of the apparatus upon activation of a lever. Examples of such apparatus are found in U.S. Pat. No. 2,401,058 to W. E. Dunleavy and U.S. Pat. No. 2,564,472 to M. R. Farnham. Such examples have no relationship to reminders for taking medicine or the like.

The prior art dealing with the dispensing of pills, as is for example shown in the first above noted patents, assumes that the person taking the pill remembers to take the pill in the first instance. The Applicants have discovered that by combining a pill dispenser and an apparatus used on a periodic basis for an altogether different purpose, the person is reminded to take the pill.

It is therefore the primary object of the present invention to provide an apparatus which provides a reminder to a person to take a pill.

It is yet another object of the invention to provide a pill reminder apparatus for use by a person taking a pill, wherein the apparatus is also used for an entirely different purpose on a periodic basis, unrelated to the taking of the pill.

SUMMARY OF THE INVENTION

The objects of the inventor are accomplished, generally, by an apparatus which houses a toothbrush, and in which a removal of the toothbrush causes the pill dispenser to open to the access of the person taking the pill.

As an alternative embodiment of the invention, after the toothbrush is removed from the apparatus, the toothbrush cannot be reinserted into the apparatus without first opening the pill dispenser.

As yet another embodiment of the invention, the toothbrush cannot be removed from the apparatus without first opening the pill dispenser.

Numerous other objects, features and advantages of the invention will be apparent from a reading of the following detailed description, which, taken in connection with the accompanying drawings, discloses the preferred embodiments thereof.

BRIEF DESCRIPTIONS OF THE DRAWINGS

Figure 4:
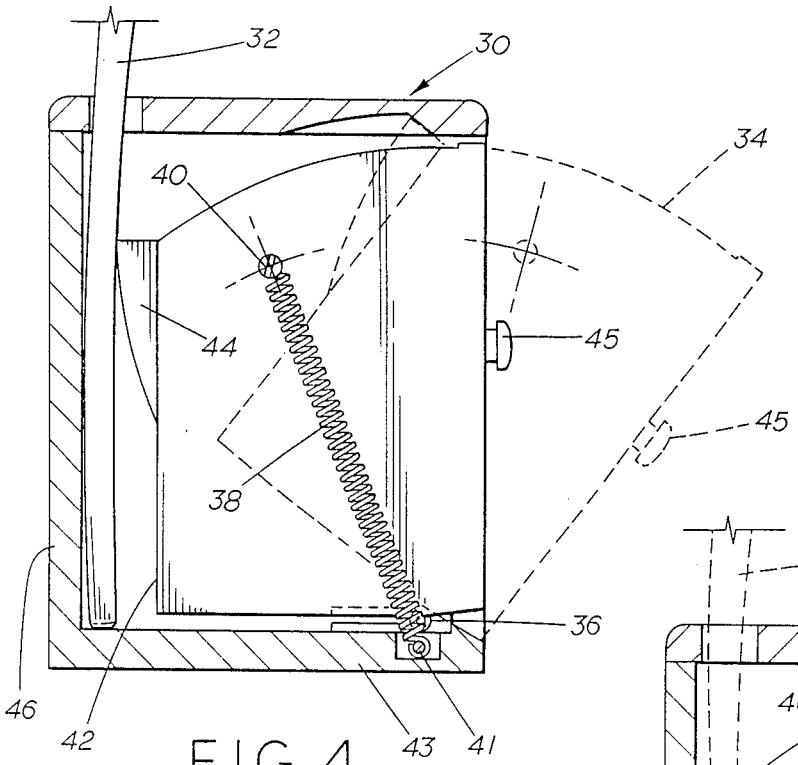
Figure 5:
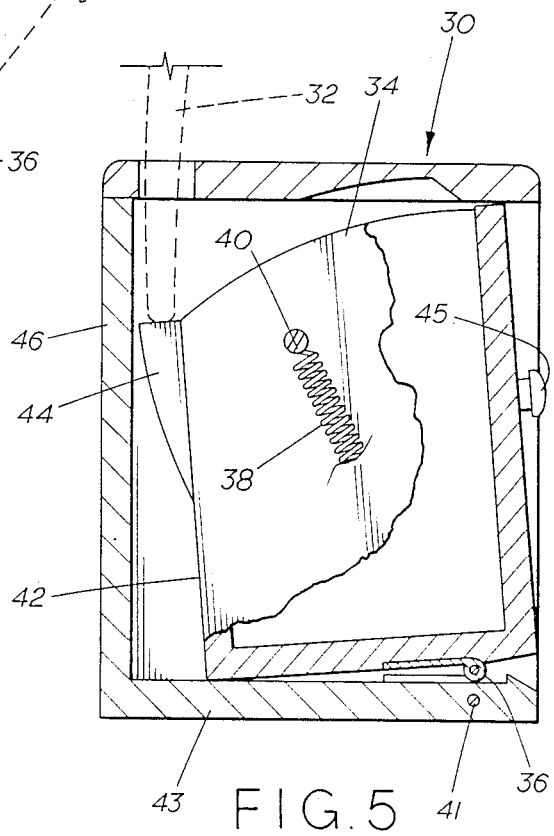
Figure 6:
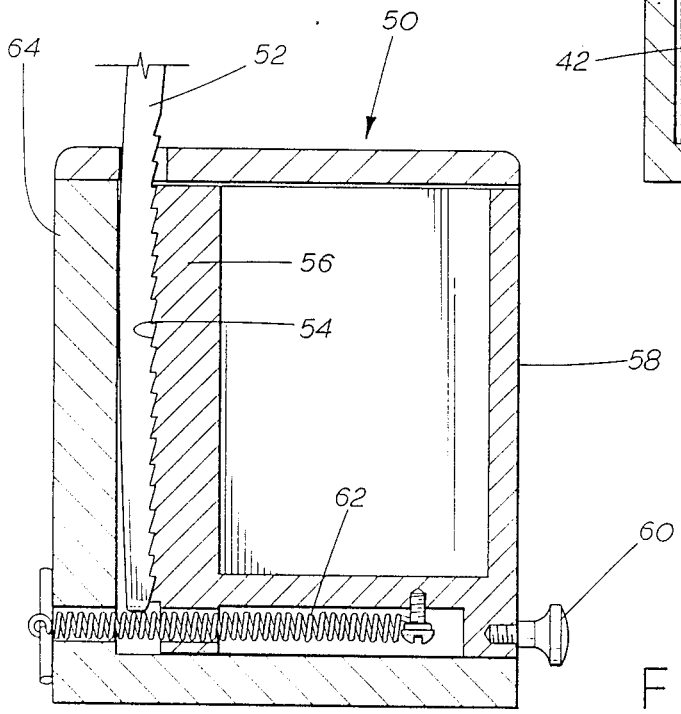

FIGS. 4 and 5 are elevated cross-sectional views of an alternative embodiment of the present invention in which the pill dispenser has to be moved toward the open position in order to reinsert the toothbrush following its use; and FIG. 6 is an elevated cross-sectional view of yet another embodiment of the present invention in which the pill dispenser cannot be moved toward the open position without first removing the toothbrush.

DETAILED DESCRIPTION OF PREFERRED EMBODIMENTS

Figure 1:
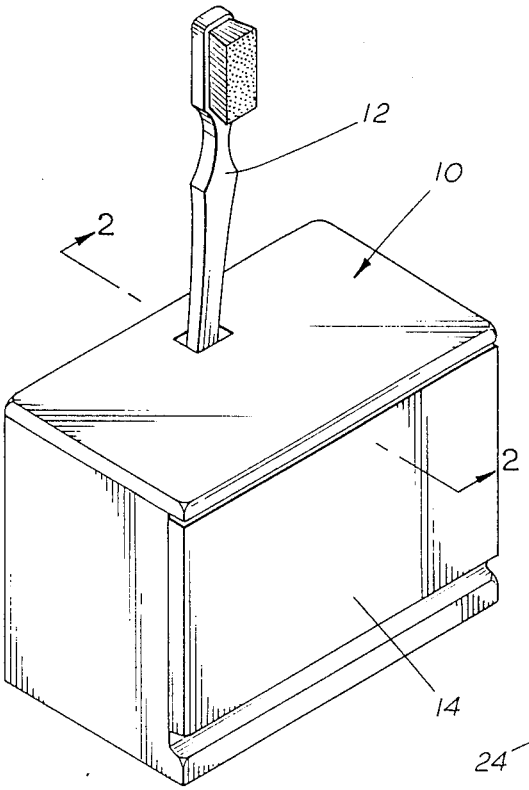
FIG. 1 is a pictorial view of the apparatus according to the present invention in which a conventional toothbrush is held within the apparatus.

Referring now to the drawings in more detail, especially to FIG. 1, there is illustrated in pictorial view the apparatus 10 having a conventional toothbrush 12 residing therein. A pill dispenser 14, best seen in cross-section in FIGS. 2 and 3, is essentially box shaped in form and has an open top into which conventional pill holders can be placed, for example, an aspirin bottle or a prescription medicine bottle.

Figure 2:
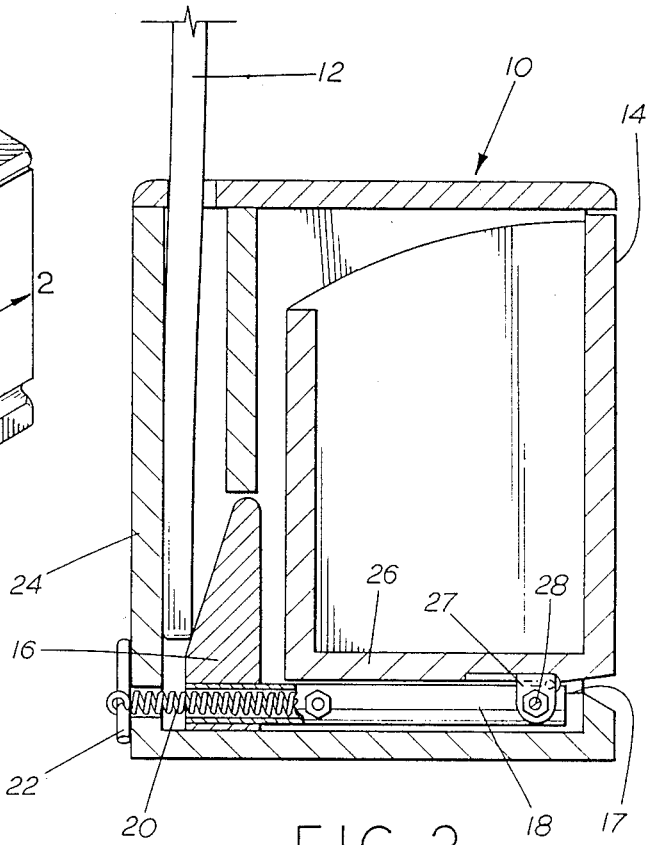
FIG. 2 is an elevated cross-sectional view of the apparatus according to FIG. 1 taken along its section lines 2—2
Figure 3:
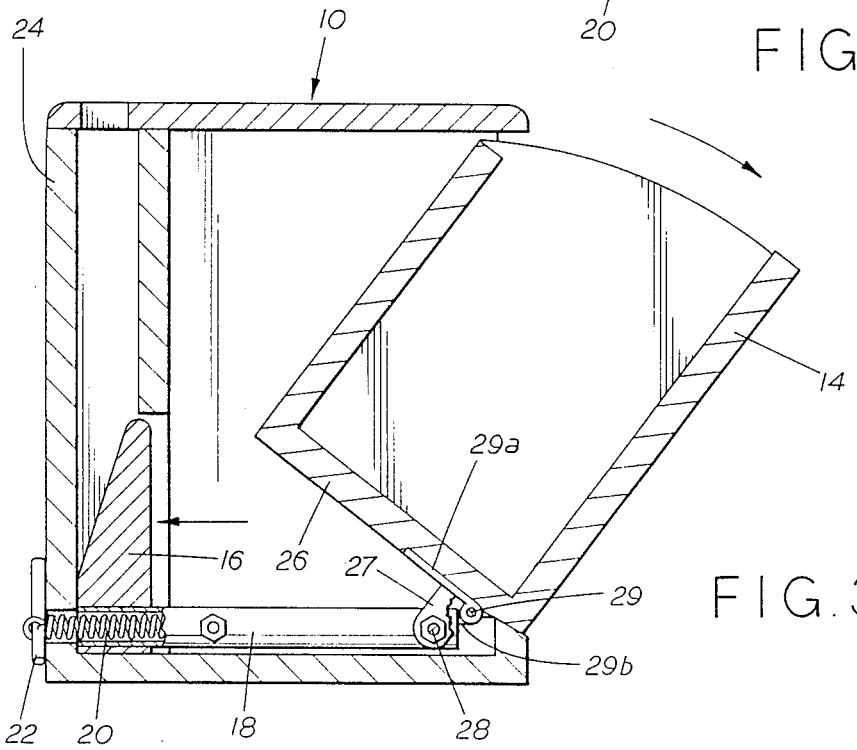
FIG. 3 is an elevated cross-sectional view of the apparatus of FIG. 2 showing the movement of the pill dispenser coincident with the removal of the toothbrush from the apparatus.

Referring specifically now to FIGS. 2 and 3, the apparatus 10 includes an inclined plane member 16 and a sliding shaft 18 passing through the inclined plane member 16. The shaft 18 is connected, for example, through a friction fit, to member 16, whereby the shaft 18 and the member 16 move as one piece. A spring 20 passes through the interior of shaft 18 and is connected at its first end to the shaft 18. The second end of spring 20 is connected to a pin 22 anchored to the exterior face of wall 24 of apparatus 10. The spring 20 passes through an opening (unnumbered) in the wall 24. It should be appreciated that the spring 20 causes the inclined plane member 16 and the sliding shaft 18 to move in a direction towards the wall 24 of the apparatus 10 upon the removal of the toothbrush 12.

The floor 26 of the pill dispenser box 14 is pivotably connected to the sliding shaft 18 at the point 28 through the use of a lever 27. The lever 27 has one end pivotally connected to point 28 on sliding shaft 18 and has its other end fixedly attached to the lower floor 26 of box 14. A hinge pin 29 having one plate **29*a* connected to floor 26, has its other plate 29*b* connected to the raised portion 17, illustrated in FIG. 2, of the lower floor of the apparatus 10. That same lower floor of the apparatus 10 is partially cut-out to accommodate the placement of the sliding shaft 18 and the inclined plane member 16**.

From the operation of the apparatus shown in FIGS. 1–3, a removal of the toothbrush 12 causes the sliding shaft 18 to move in the direction of the wall 24, thus pulling the lever 27 and thus causing the pill dispenser box 14 to rotate around the hinge pin 29, thus making the pills contained within the dispenser 14 readily accessible to the person taking the pills.

After the teeth have been brushed and the pills removed from the pill dispenser box 14, the apparatus 10 can be reset in one of three ways. First of all, the box 14 can be pushed in, causing it to rotate around the point 28, thus allowing room to reinsert the toothbrush 12 as illustrated in FIG. 2. Alternatively, the reinsertion of the toothbrush 12 against the inclined plane number 16 will also cause the rotation of the pill dispenser 14 back into its position as is illustrated in FIG. 2. As a third way, the toothbrush 12 can be partially inserted, resting at its lower end on the inclined plane member 16. When the box 14 is closed, the toothbrush will fall by its own weight, causing a jamming action which will keep the box closed. In this embodiment, the invention works quite well with an assortment of different name brand and sizes of toothbrushes.

FIG. 4 illustrates an alternative embodiment of the present invention, with the apparatus generally shown as 30. The conventional toothbrush 32, only partially illustrated, is shown as residing within the apparatus 30. A pill dispensing box 34 is pivotably connected to the lower floor of the apparatus 30 at point 36. A spring 38 has one of its ends anchored at point 41 on the floor 43 of the apparatus 30 and has it other end connected at a point 40 on one of the side walls of the pill dispenser 34. The rear wall 42 of the dispenser box 34 has a projection 44 which serves to prevent complete reinsertion of the toothbrush 32 after the pill box 34 has been opened, as is best illustrated in FIG. 5.

In the operation of the apparatus illustrated in FIGS. 4 and 5, it should be appreciated that before the toothbrush 32 is removed from the apparatus 30, the off-centered location of the spring 38 causes the box 34 to remain closed. After the box 34 is open, the same spring 38 causes the box to remain open because of the off-centered nature of the spring. Thus, when the toothbrush 32 is removed to brush the pill-taker's teeth, the toothbrush 32 cannot be reinserted because the spring 38 causes the projection 44 to either be up against the back wall 46 of the apparatus 30, or close enough to it to prevent the complete reinsertion of the toothbrush 32. Thus, in order to reinsert the toothbrush 32, the pill taker is reminded to at least partially open the pill box, by pulling knob 45, thus exposing the interior of pill box 34 with its supply of aspirin or other medicine to the pill-taker.

Referring now to FIG. 6, an alternative embodiment of the present invention is illustrated in which the apparatus 50 uses a non-conventional toothbrush 52 having teeth 54 along the length of its handle which are sized to mesh with teeth of similar spacing on the back wall 56 of the pill dispenser box 58. Instead of pivoting like the pill dispensing boxes 14 and 34 of the preceding embodiments, the pill dispenser 58 is slideably removed from the apparatus 50 by pulling on the knob 60. A spring 62 has one of its ends anchored in the floor of the pill dispensing box 58 and its other end anchored to the exterior wall 64 of the apparatus 50. The spring 62 causes the back wall 56 of the pill dispensing box 58 to be pressed against the toothbrush 52. The spring force coupled with the meshed serrated edges of the toothbrush 52 and the backwall 56 of the dispenser 58 prevents the toothbrush 52 from being removed from the apparatus 50 without first opening the pill dispensing box 58 by pulling on the knob 60. After the teeth have been brushed and the pills taken, the toothbrush 52 can either be reinserted by racheting in the toothbrush past the serrated edges of the back wall 56 or alternatively, the toothbrush 52 can be reinserted and then the pill dispensing box 58 closed.

Thus, it should be appreciated in the preferred embodiments that there have been illustrated and described herein apparatus which either automatically open when the toothbrush is removed, or alternatively, include means which prevent the toothbrush from being reinserted in the apparatus without first opening the pill dispenser, or alternatively, include means which prevent the toothbrush from being removed from the apparatus without first opening the pill dispenser.

This present invention utilizes the fact that while people, especially elderly people, cannot remember to take their pills in the morning, they can remember and do remember other tasks which they have done for so many years, for example, brush their teeth. By providing apparatus which force them to remember to take their medicine as an integral part of brushing their teeth, they have thus been reminded to take their medicine.

Other tasks which people do on a periodic basis may also be used as a basis for constructing a pill reminder apparatus. For example, instead of using a toothbrush, the apparatus according to the present invention could use a comb or a hairbrush in any of the embodiments illustrated in FIGS. 1–6.

What is claimed is:

1. A pill reminder apparatus, comprising:

a first housing having a cover, wherein said cover has an opening for receiving the handle of a toothbrush;

a second housing for storing pills and having a first and second positions within said first housing; and means totally internal of said first housing and automatically responsive to the removal of said toothbrush from said apparatus for automatically causing said second housing to move from said first position to said second position as the result of the toothbrush handle being removed from the apparatus, said second position providing access to any pills stored within said second housing.

2. A pill reminder apparatus, comprising:

a first housing having a cover, wherein said cover has an opening for receiving the handle of a toothbrush;

a second housing for storing pills and having first and second positions within said first housing; and means within said first housing for causing said second housing to move from said first position to said second position upon the removal of the toothbrush handle from the apparatus, said second position providing access to any pills stored within said second housing, said means comprising:

an inclined plane member;

a sliding shaft having first and second ends, the first end of said shaft connected to said inclined plane member and the second end of said shaft pivotally connected to said second housing;

a spring located within said shaft and having first and second ends, said first end of said spring connected to said first housing and said second end of said spring connected to said sliding shaft; and a hinge pin connecting the said first housing to said second housing.

* * * * *